US010549572B1

(12) United States Patent
McTague

(10) Patent No.: US 10,549,572 B1
(45) Date of Patent: Feb. 4, 2020

(54) LINE-MARKING TOOL

(71) Applicant: James McTague, Crystal Lake, IL (US)

(72) Inventor: James McTague, Crystal Lake, IL (US)

( * ) Notice: Subject to any disclaimer, the term of this patent is extended or adjusted under 35 U.S.C. 154(b) by 214 days.

(21) Appl. No.: 15/871,244

(22) Filed: Jan. 15, 2018

(51) Int. Cl.
*B43L 7/10* (2006.01)
*B43L 7/00* (2006.01)
*B43L 13/02* (2006.01)

(52) U.S. Cl.
CPC ..... *B43L 7/007* (2013.01); *B43L 7/002* (2013.01); *B43L 7/005* (2013.01); *B43L 7/10* (2013.01); *B43L 13/02* (2013.01)

(58) Field of Classification Search
CPC ..... B43L 7/002; B43L 7/007; B43L 7/10
USPC ..... 33/483, 430, 435, 436, 443, 465, 471, 33/32.1, 32.3, 452
See application file for complete search history.

(56) References Cited

U.S. PATENT DOCUMENTS 577,709 A 2/1897 Beddow
1,086,545 A 2/1914 Meister
2,054,420 A * 9/1936 Hochman ..... B43L 7/005 33/495
2,741,030 A 4/1956 Wise
2,993,281 A 7/1961 Russell
3,389,470 A * 6/1968 Johnson ..... B43L 13/141 33/434
3,942,252 A * 3/1976 Roach ..... G01B 3/04 33/471
4,125,942 A * 11/1978 Horner ..... B23Q 1/621 33/430
4,194,295 A 3/1980 Simuro
4,481,720 A 11/1984 Sury
4,611,407 A * 9/1986 van Gorp ..... B23Q 9/005 33/471
4,918,822 A * 4/1990 Levitt ..... B43L 13/141 33/1 K
4,955,141 A * 9/1990 Welch ..... G01B 3/56 33/418
5,915,807 A * 6/1999 Ilagan ..... B43L 13/08 33/32.3
D432,928 S 10/2000 Garrett
D438,978 S 3/2001 Conwell
6,450,980 B1 9/2002 Robbins
(Continued)

FOREIGN PATENT DOCUMENTS

WO 1979000974 11/1979
WO 2007023264 A 3/2007

*Primary Examiner* — Christopher W Fulton
(74) *Attorney, Agent, or Firm* — Kyle A. Fletcher, Esq.

(57) ABSTRACT

The line-marking tool attaches to a pad of paper. The line-marking tool comprises an anchored straight edge, a rotating straight edge, and a slewing bearing. The slewing bearing attaches the rotating straight edge to the anchored straight edge. The anchored straight edge attaches to the pad of paper such that the position of the anchored straight edge relative to the top sheet of the pad of paper is fixed. The anchored straight edge and the rotating straight edge are used to draw straight lines on the top sheet. The slewing bearing adjusts the cant of the rotating straight edge relative to the anchored straight edge such that a cant is formed between a line drawn using the rotating straight edge and a line drawn using the anchored straight edge. The slewing bearing is calibrated to form a precise angle of cant on the top sheet.

18 Claims, 5 Drawing Sheets

(56) References Cited

U.S. PATENT DOCUMENTS

| | | | | |
|---|---|---|---|---|
| 6,467,179 | B1 * | 10/2002 | Wolf | B43L 7/027 33/465 |
| 6,708,422 | B1 * | 3/2004 | Stojanovski | B23Q 9/005 33/42 |
| D488,231 | S | 4/2004 | Sorlie | |
| 7,082,692 | B2 * | 8/2006 | Shapiro | B43L 7/10 33/464 |
| 7,399,287 | B2 | 7/2008 | Meisch | |
| 7,596,878 | B2 | 10/2009 | Mailloux | |
| D610,925 | S | 3/2010 | Pater | |
| 8,661,698 | B2 | 3/2014 | Kailabis | |
| 2003/0208144 | A1 | 11/2003 | Sorlie | |
| 2004/0006881 | A1 * | 1/2004 | Shapiro | G01B 3/56 33/471 |
| 2004/0049138 | A1 | 3/2004 | Li | |
| 2005/0043656 | A1 | 2/2005 | Lacey | |
| 2006/0005408 | A1 * | 1/2006 | Fernand | B26B 29/06 33/471 |
| 2012/0121313 | A1 | 5/2012 | Thiebaut | |

* cited by examiner

LINE-MARKING TOOL

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of printing including writing and drawing instruments, more specifically, a straight edge combined with other accessories.

SUMMARY OF INVENTION

The line-marking tool is configured for use as a drafting tool. The line-marking tool is configured for use with a drafting instrument such as a pencil. The line-marking tool is configured for use with a pad of paper. The pad of paper is further defined with a top sheet. The top sheet is identified as the sheet of paper that is marked by a drafting instrument when the line-marking tool is in use. The line-marking tool attaches to the pad of paper. The line-marking tool comprises an anchored straight edge, a rotating straight edge, and a slewing bearing. The slewing bearing attaches the rotating straight edge to the anchored straight edge. The anchored straight edge attaches to the pad of paper such that the position of the anchored straight edge relative to the top sheet of the pad of paper is fixed. The anchored straight edge is used to draw straight lines on the top sheet. The rotating straight edge is used to draw straight lines on the top sheet. The slewing bearing adjusts the cant of the rotating straight edge relative to the anchored straight edge such that a cant is formed between a line drawn using the rotating straight edge and a line drawn using the anchored straight edge. The slewing bearing is calibrated such that a precise angle of cant may be drawn on the top sheet.

These together with additional objects, features and advantages of the line-marking tool will be readily apparent to those of ordinary skill in the art upon reading the following detailed description of the presently preferred, but nonetheless illustrative, embodiments when taken in conjunction with the accompanying drawings.

In this respect, before explaining the current embodiments of the line-marking tool in detail, it is to be understood that the line-marking tool is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the line-marking tool.

It is therefore important that the claims be regarded as including such equivalent construction insofar as they do not depart from the spirit and scope of the line-marking tool. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
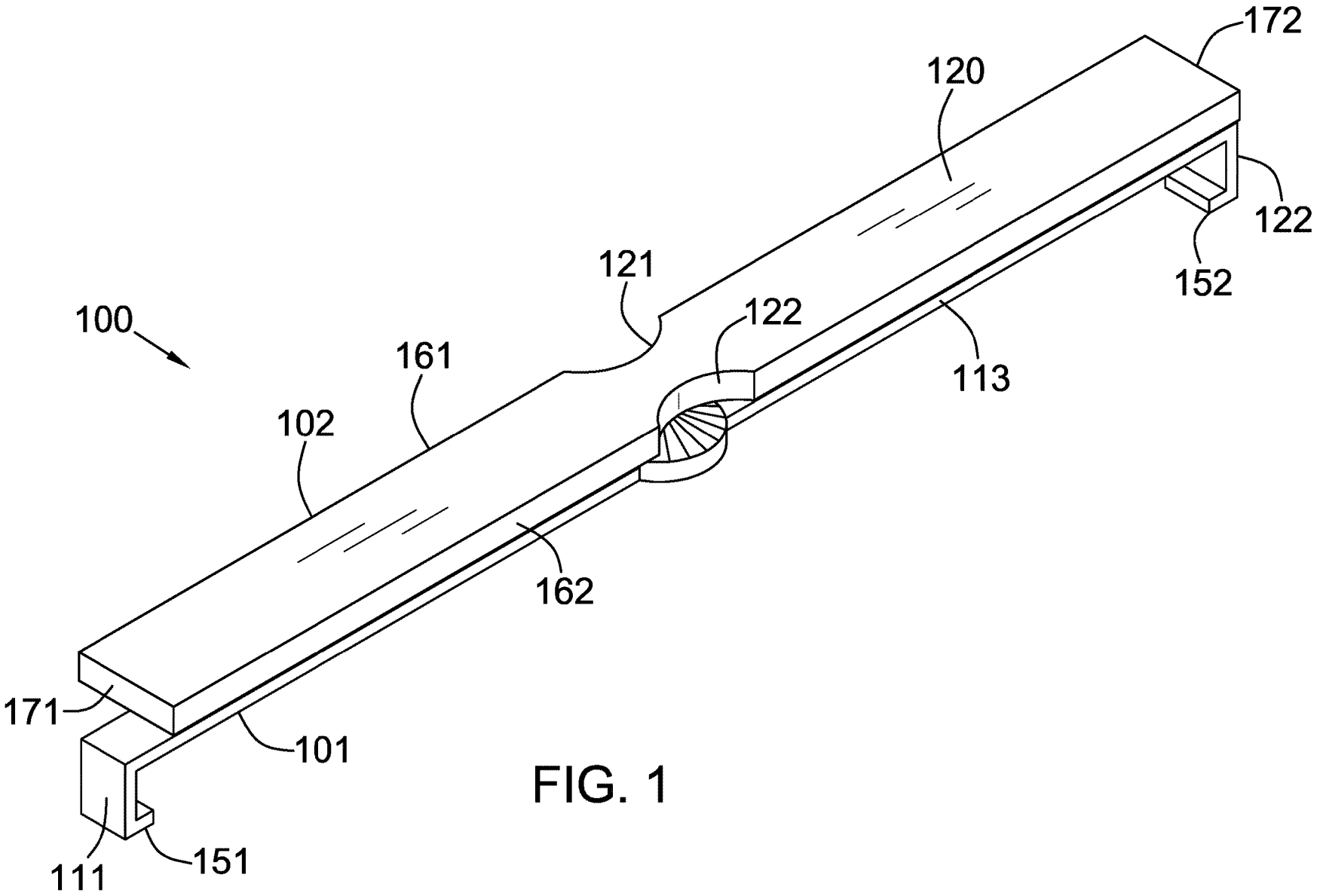
FIG. 1 is a perspective view of an embodiment of the disclosure.
Figure 2:
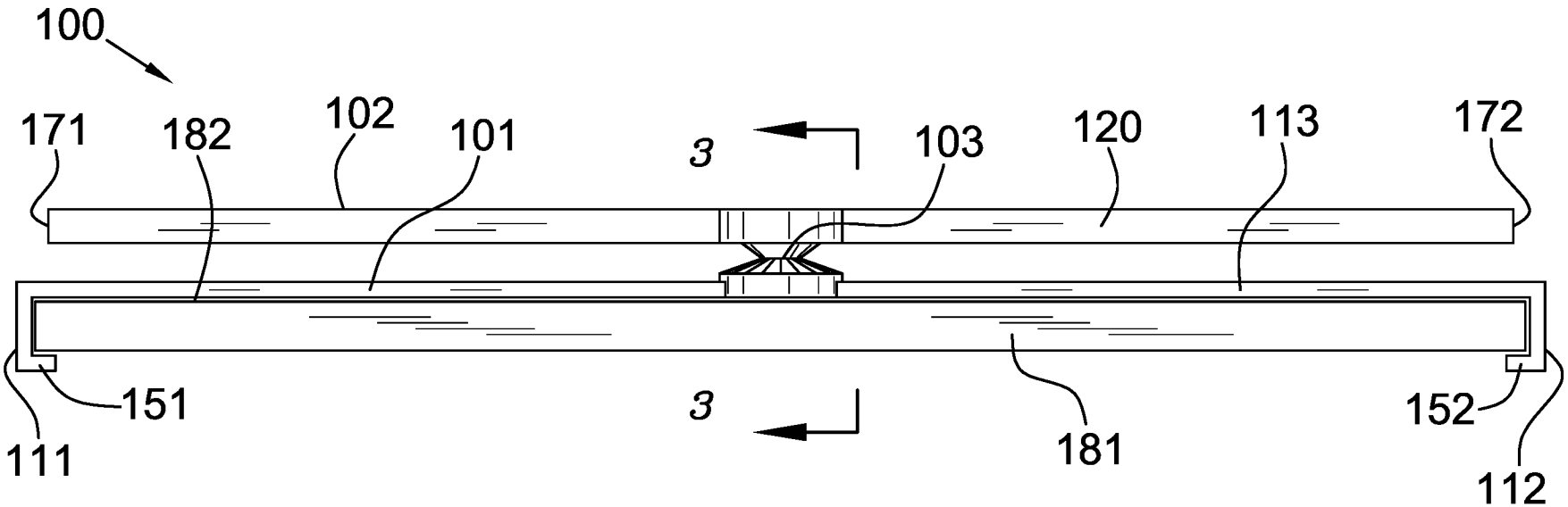
FIG. 2 is a front view of an embodiment of the disclosure.
Figure 3:
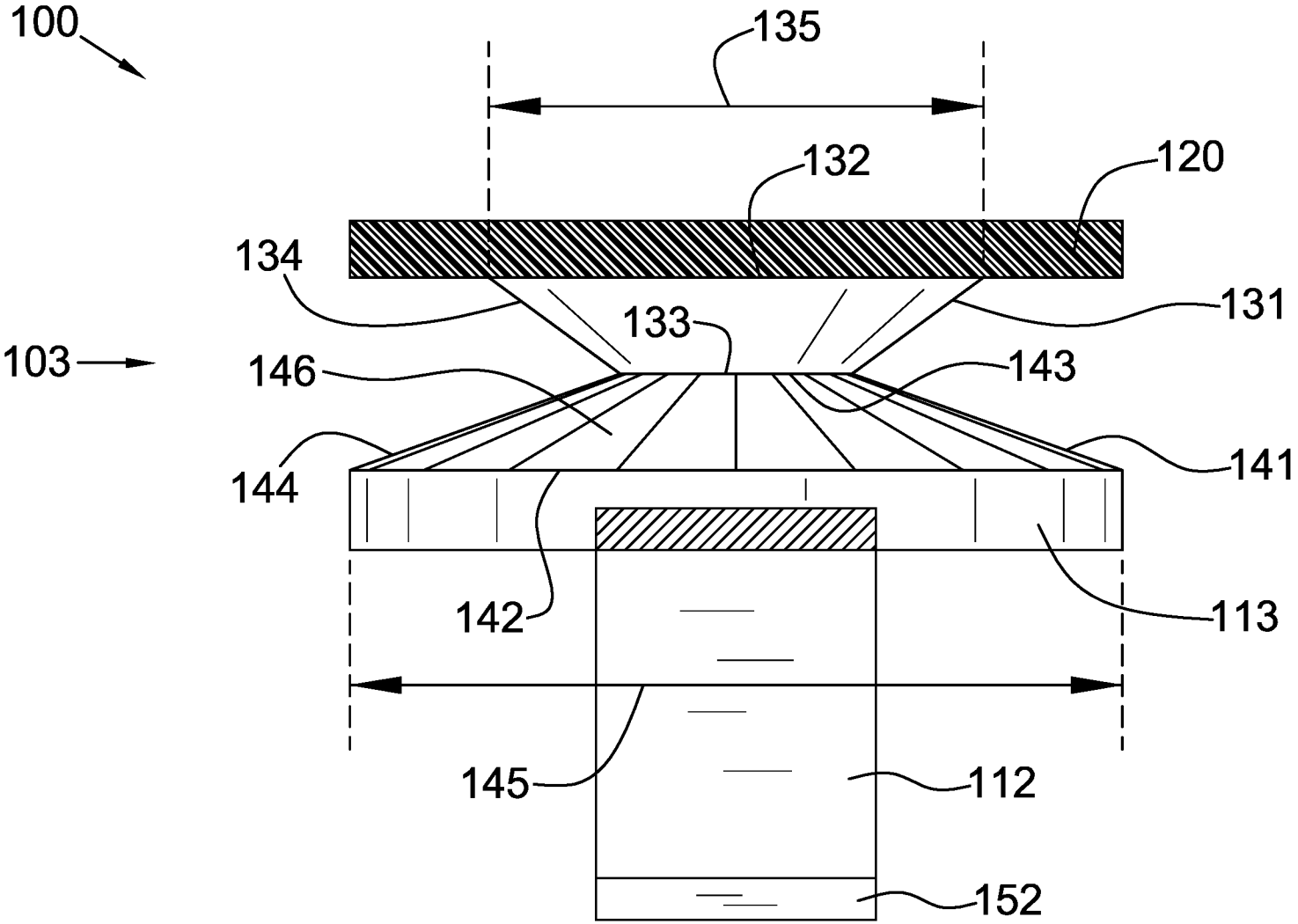
FIG. 3 is a cross-sectional view of an embodiment of the disclosure across 3-3 as shown in FIG. 2.
Figure 4:
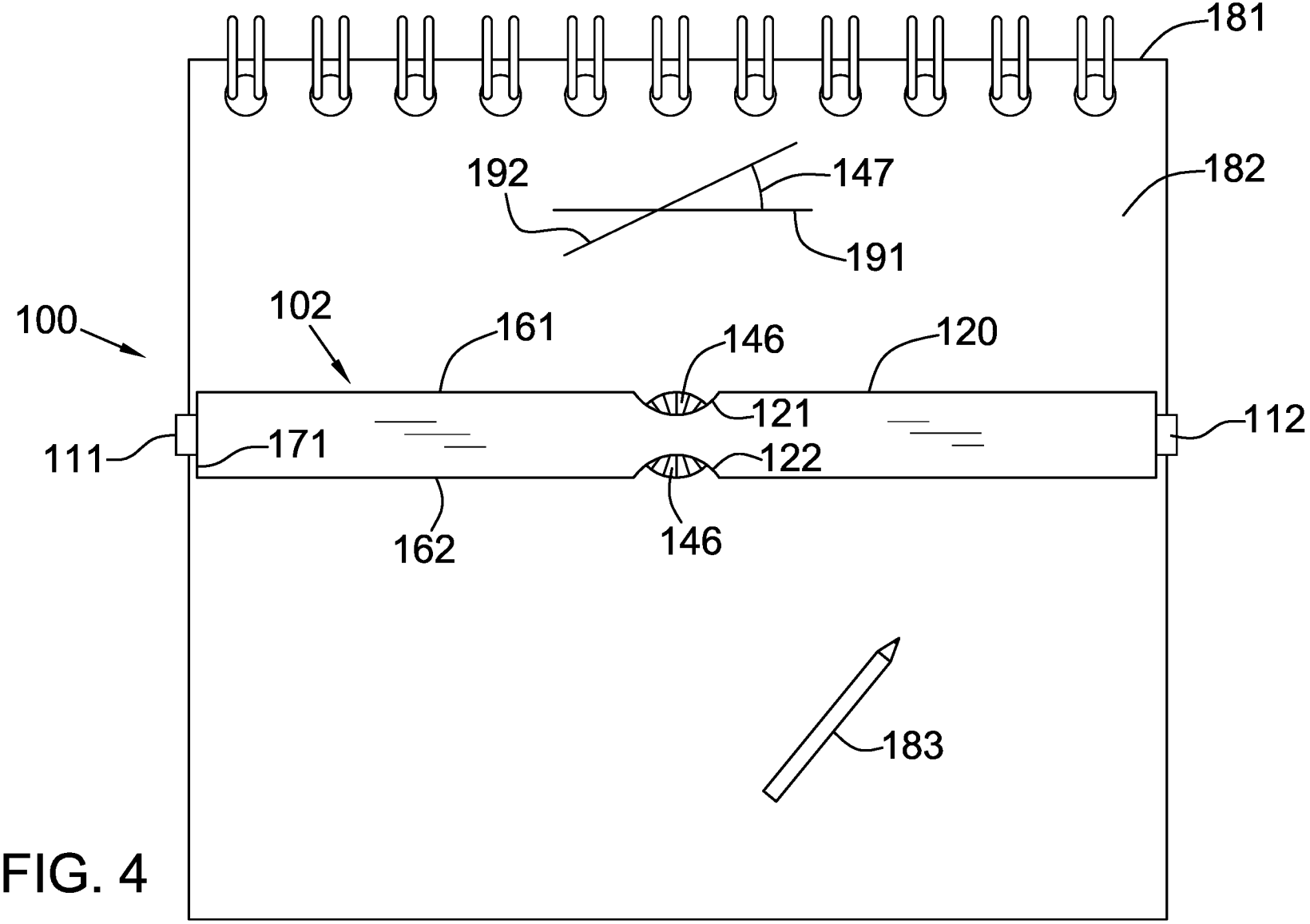
FIG. 4 is an in-use view of an embodiment of the disclosure.
Figure 5:
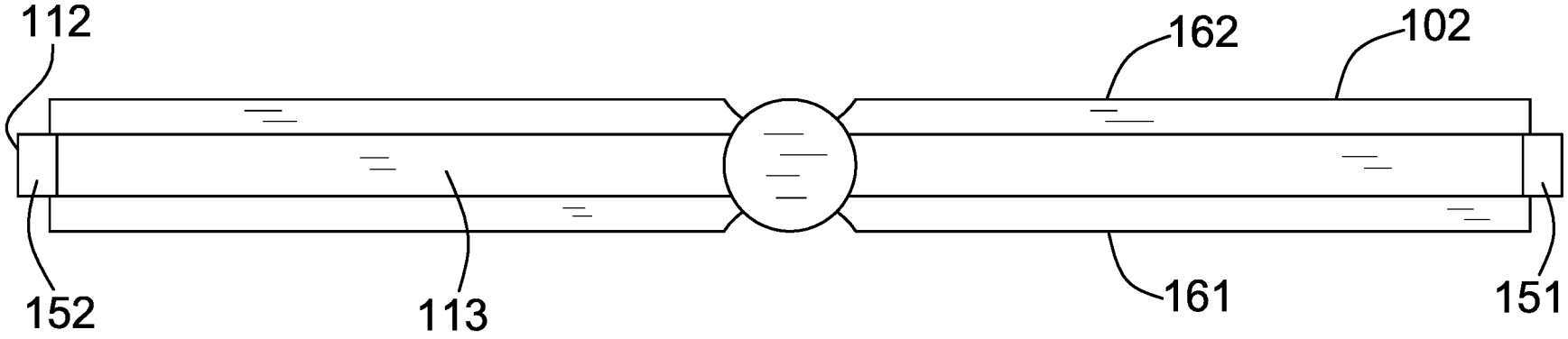
FIG. 5 is a bottom view of an embodiment of the disclosure.

Detailed reference will now be made to one or more potential embodiments of the disclosure, which are illustrated in FIGS. 1 through 5.

The line-marking tool 100 (hereinafter invention) is configured for use as a drafting tool. The invention 100 is configured for with a drafting instrument 183 such as a pencil. The invention 100 is configured for use with a pad of paper 181. The pad of paper 181 is further configured with a top sheet 182. The top sheet 182 is the sheet of paper that is marked by a drafting instrument 183 when the invention 100 is in use. The invention 100 attaches to the pad of paper 181. The invention 100 comprises an anchored straight edge 101, a rotating straight edge 102, and a slewing bearing 103. The slewing bearing 103 attaches the rotating straight edge 102 to the anchored straight edge 101. The anchored straight edge 101 attaches to the pad of paper 181 such that the position of the anchored straight edge 101 relative to the top sheet 182 of the pad of paper 181 is fixed. The anchored straight edge 101 is used to draw straight lines on the top sheet 182. The rotating straight edge 102 is used to draw straight lines on the top sheet 182. The slewing bearing 103 adjusts the first cant 147 of the rotating straight edge 102 relative to the anchored straight edge 101 such that a first cant 147 is formed between a second line 192 drawn using the rotating straight edge 102 and a first line 191 drawn using the anchored straight edge 101. The slewing bearing 103 is calibrated such that a precise angle of the first cant 147 may be drawn on the top sheet 182.

The anchored straight edge 101 is a rectilinear structure. The anchored straight edge 101 has the shape of a hyoid. The anchored straight edge 101 forms a straight edge used to draw straight edges on the top sheet 182 of the pad of paper 181. The anchored straight edge 101 attaches to the pad of paper 181 such that any initial first line 191 drawn on the top sheet 182 using the anchored straight edge 101 is parallel to any subsequent first line 191 drawn on the top sheet 182 using the anchored straight edge 101. The first line 191 refers to a straight line drawn on the top sheet 182 of the pad of paper 181 using a drafting instrument 183 that is guided by the anchored straight edge 101. The anchored straight edge 101 comprises a first arm 111, a second arm 112, and a crossbeam 113.

The first arm 111 is a plate with a rectangular block shape. The first arm 111 attaches to an edge of the crossbeam 113 such that the first arm 111 projects perpendicularly away from the crossbeam 113. The first arm 111 projects away from the crossbeam 113 in the direction away from the surface of the crossbeam 113 upon which the slewing bearing 103 is mounted. The first arm 111 further comprises a first ledge 151.

The first ledge 151 is a plate with a rectangular block shape. The first ledge 151 attaches to the edge of the first arm 111 that is distal from the crossbeam 113. The first ledge 151 projects perpendicularly away from the first arm 111 in the direction towards the second arm 112. The first ledge 151 hooks around the surface of the pad of paper 181 that is distal from the top sheet 182 of the pad of paper 181. The first ledge 151 holds the crossbeam 113 in a fixed position relative to the pad of paper 181.

The second arm 112 is a plate with a rectangular block shape. The second arm 112 attaches to an edge of the crossbeam 113 such that the second arm 112 projects perpendicularly away from the crossbeam 113. The second arm 112 projects away from the crossbeam 113 in the direction away from the surface of the crossbeam 113 upon which the slewing bearing 103 is mounted. The second arm 112 is identical to the first arm 111. The second arm 112 is located on the edge of the crossbeam 113 that is distal from the first arm 111. The second arm 112 further comprises a second ledge 152.

The second ledge 152 is a plate with a rectangular block shape. The second ledge 152 attaches to the edge of the second arm 112 that is distal from the crossbeam 113. The second ledge 152 projects perpendicularly away from the second arm 112 in the direction towards the first arm 111. The second ledge 152 hooks around the surface of the pad of paper 181 that is distal from the top sheet 182 of the pad of paper 181. The second ledge 152 holds the crossbeam 113 in a fixed position relative to the pad of paper 181.

The crossbeam 113 is a plate with a rectangular block shape. The crossbeam 113 attaches the first arm 111 to the second arm 112. The crossbeam 113 forms the straight edges of the anchored straight edge 101. The crossbeam 113 forms a plurality of straight edges that will guide a drafting instrument 183 during the formation of a straight first line 191. The slewing bearing 103 attaches to the surface of the crossbeam 113 that is proximal to the rotating straight edge 102.

The rotating straight edge 102 is a plate. The rotating straight edge 102 has the shape of a rectangular block. The rotating straight edge 102 attaches to the anchored straight edge 101 such that the rotating straight edge 102 rotates relative to the anchored straight edge 101. The rotating straight edge 102 is used with a drafting instrument 183 to draw a second line 192. The second line 192 refers to a straight line drawn on the top sheet 182 of the pad of paper 181 using a drafting instrument 183 that is guided by the rotating straight edge 102. The second line 192 formed by the drafting instrument 183 using the rotating straight edge 102 forms a first cant 147 with the first line 191. The measure of the first cant 147 can be zero. The first cant 147 formed between the first line 191 and the second line 192 is adjustable over the entire arc of a circle.

The rotating straight edge 102 comprises a rectangular plate 120, a first notch 121, and a second notch 122. The rectangular plate 120 is further defined with a first primary edge 161, a second primary edge 162, a first lateral edge 171, and a second lateral edge 172. The first primary edge 161 refers to the longest edge of the rectangular plate 120. The second primary edge 162 refers to the edge of the rectangular plate 120 that is distal from the first primary edge 161. The first lateral edge 171 is the shortest edge of the rectangular plate 120. The second lateral edge 172 refers to the edge of the rectangular plate 120 that is distal from the first lateral edge 171. The first primary edge 161 and the second primary edge 162 form the straight edges of the rotating straight edge 102.

The rectangular plate 120 is a plate with a rectangular block shape. The rectangular plate 120 forms a plurality of straight edges that will guide a drafting instrument 183 during the formation of a straight second line 192. The slewing bearing 103 attaches to the surface of the rectangular plate 120 that is proximal to the crossbeam 113. The slewing bearing 103 attaches the rectangular plate 120 to the crossbeam 113 such that the rectangular plate 120 rotates relative to the crossbeam 113.

The first notch 121 is a negative space formed through the rectangular plate 120. The first notch 121 has the shape of a circular section. The first primary edge 161 of the rectangular plate 120 aligns with the bifurcating line of the circular section that forms the first notch 121. The opening formed by the first notch 121 creates a first visible space through which the angular calibration 146 of the slewing bearing 103 can be viewed.

The second notch 122 is a negative space formed through the rectangular plate 120. The second notch 122 has the shape of a circular section. The second primary edge 162 of the rectangular plate 120 aligns with the bifurcating line of the circular section that forms the second notch 122. The opening formed by the second notch 122 creates a second visible space through which the angular calibration 146 of the slewing bearing 103 can be viewed.

The centers of the circles that form the first notch 121 and the second notch 122 are positioned on the rectangular plate 120 such that the center of the rectangular plate 120, the center of the circle that forms the first notch 121, and the center of the circle that forms the second notch 122 align. The line formed by the center of the rectangular plate 120, the center of the circle that forms the first notch 121, and the center of the circle that forms the second notch 122 is perpendicular to both the first primary edge 161 and the second primary edge 162.

The slewing bearing 103 attaches the rotating straight edge 102 to the anchored straight edge 101. The slewing bearing attaches the rotating straight edge 102 to the anchored straight edge 101 such that the center of the slewing bearing 103, the center of the anchored straight edge 101, and the center of the rotating straight edge 102 are aligned. The alignment of the slewing bearing 103 is such that the line formed by the centers of the anchored straight edge 101, the rotating straight edge 102, and the slewing bearing 103 are perpendicular to the larger faces of both the anchored straight edge 101 and the rotating straight edge 102.

The slewing bearing 103 attaches the rotating straight edge 102 to the anchored straight edge 101 such that the rotating straight edge 102 rotates relative to the anchored straight edge 101. The slewing bearing 103 attaches the rotating straight edge 102 to the anchored straight edge 101 such that face of the rotating straight edge 102 is parallel to the face of the anchored straight edge 101.

The slewing bearing 103 comprises an upper truncated cone 131 and a lower truncated cone 141. The upper truncated cone 131 is further defined with an upper base 132, an upper apex 133, and an upper lateral face 134. The lower truncated cone 141 is further defined with a lower base 142, a lower apex 143, and a lower lateral face 144. The upper base 132 is further defined with an upper diameter 135. The lower base 142 is further defined with a lower diameter 145.

The upper truncated cone 131 forms the portion of the slewing bearing 103 that attaches to the rotating straight edge 102. The upper base 132 of the upper truncated cone 131 attaches to the rectangular plate 120 such that the center axis of the upper truncated cone 131 passes through the center of the rectangular plate 120. The span of the upper diameter 135 of the upper base 132 is less than or equal to the perpendicular span of the distance between the first primary edge 161 and the second primary edge 162. The upper apex 133 is the truncated surface formed by the truncation of the apex of the upper truncated cone 131. The upper apex 133 is parallel to the upper base 132. The upper diameter 135 refers to the diameter of the upper base 132 of the upper truncated cone 131.

The lower truncated cone 141 forms the portion of the slewing bearing 103 that attaches to the anchored straight edge 101. The lower base 142 of the lower truncated cone 141 attaches to the crossbeam 113 such that the center axis of the lower truncated cone 141 passes through the center of the crossbeam 113. The span of the lower diameter 145 of the lower base 142 is less than or equal to the perpendicular span of the distance between the first primary edge 161 and the second primary edge 162. The lower diameter 145 refers to the diameter of the lower base 142 of the lower truncated cone 141.

The lower apex 143 is the truncated surface formed by the truncation of the apex of the lower truncated cone 141. The lower apex 143 is parallel to the lower base 142. The span of the diameter of the lower apex 143 equals the span of the diameter of the upper apex 133. A bearing attaches the lower apex 143 to the upper apex 133 such that the upper truncated cone 131 rotates relative to the lower truncated cone 141.

The lower truncated cone 141 further comprises an angular calibration 146. The angular calibration 146 is a collection of markings that are formed on the lower lateral face 144 of the lower truncated cone 141. The angular calibration 146 provides a visual indication of the span of the arc of a circle. The span of the lower diameter 145 of the lower truncated cone 141 is greater than the span of the upper diameter 135 of the upper truncated cone 131 such that the upper truncated cone 131 does not interfere with the visibility of the angular calibration 146 of the lower truncated cone 141.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Anchor: As used in this disclosure, anchor means to hold an object firmly or securely.

Anchor Point: As used in this disclosure, an anchor point is a location to which a first object can be securely attached to a second object.

Arc: As used in this disclosure, an arc refers to a portion of a circumference or a curved perimeter. When applied to an angle, the arc also refers to a measure of an angular span as measured from a circle at the vertex formed by the sides of the angle.

Bearing: As used in this disclosure, a bearing is a mechanical device that: 1) guides and limits the motion of a moving component relative to a fixed component; and, 2) reduces the friction between the moving component and the fixed component. The use of bearings is well known and documented in the mechanical arts.

Calibration: As used in this disclosure, a calibration refers to a standard scale that is marked on an instrument and that is used for measurement. In its verbal form, to calibrate refers to comparing an instrument's calibration against a known and trusted standard to ensure that the calibration of the remains correct.

Cant: As used in this disclosure, a cant is an angular deviation from one or more reference lines (or planes) such as a vertical line (or plane) or a horizontal line (or plane).

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center of Rotation: As used in this disclosure, the center of rotation is the point of a rotating plane that does not move with the rotation of the plane. A line within a rotating three-dimensional object that does not move with the rotation of the object is also referred to as an axis of rotation.

Circular Section: As used in this disclosure, a circular section refers one of the two objects formed by the bifurcation of a circle by a plane that does not pass through the center of the circle. The major section is the circular section that contains the larger area. The minor section is the circular section that contains the smaller area.

Cone: As used in this disclosure, a cone is a surface that is generated by rotating a triangle around one of the legs of the triangle. If a line that is perpendicular to the base that is drawn from the center of the base goes through the vertex of the triangle then the cone is called a right cone. A cone is a type of quadric surface. The cone is a pyramid with a circular base. The cone is further defined with an apex, a base, and a lateral face.

Diameter: As used in this disclosure, a diameter of an object is a straight line segment (or a radial line) that passes through the center (or center axis) of an object. The line segment of the diameter is terminated at the perimeter or boundary of the object through which the line segment of the diameter runs. A radius refers to the line segment that overlays a diameter with one termination at the center of the object. A span of a radius is always one half the span of the diameter.

Hook: As used in this disclosure, a hook is an object that is curved or bent at an angle such that items can be hung on or caught by the object.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Hyoid: As used in this disclosure, a hyoid refers to a three-sided structure comprising a crossbeam, a first arm, and a second arm. In a hyoid, the first arm and the second arm project away from the crossbeam: 1) in the same direction; 2) at a roughly perpendicular angle to the crossbeam, and, 3) the span of length of the first arm roughly equals the span of length of the second arm. Hyoids generally have a U shaped appearance.

Ledge: As used in this disclosure, a ledge is a horizontal surface that projects away from a vertical surface.

Negative Space: As used in this disclosure, negative space is a method of defining an object through the use of open or empty space as the definition of the object itself, or, through the use of open or empty space to describe the boundaries of an object.

Notch: As used in this disclosure, a notch is: 1) an indentation formed in an edge; or 2) a cavity or aperture formed within a surface.

Plate: As used in this disclosure, a plate is a smooth, flat and semi-rigid or rigid structure that has at least one dimension that: 1) is of uniform thickness; and 2) that appears thin relative to the other dimensions of the object. Plates often have a rectangular or disk-like appearance.

Radial: As used in this disclosure, the term radial refers to a direction that: 1) is perpendicular to an identified central axis; or, 2) projects away from a center point.

Rectangular Block: As used in this disclosure, a rectangular block refers to a three-dimensional structure comprising six rectangular surfaces formed at right angles. Within this disclosure, a rectangular block may further comprise rounded edges and corners.

Rectilinear: As used in this disclosure, rectilinear is an adjective that is used to describe an object that: 1) moves in a straight line or lines; 2) consists of a straight line or lines; 3) is bounded by a straight line or lines; or, 4) is otherwise characterized by a straight line or lines.

Slewing Bearing: As used in this disclosure, a slewing bearing is a device that is used to rotate an object on a horizontal surface. Slewing bearings are often called turntable Truncated: As used in this disclosure, a geometric object is truncated when an apex, vertex, or end is cut off by a line or plane.

Truncated Cone: As used in this disclosure, a truncated cone is a frustum that remains when the apex of a cone is truncated by a plane that is parallel to the base of the cone.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

With respect to the above description, it is to be realized that the optimum dimensional relationship for the various components of the invention described above and in FIGS. 1 through 5 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A drafting tool comprising:

an anchored straight edge, a rotating straight edge, and a slewing bearing;

wherein the slewing bearing attaches the rotating straight edge to the anchored straight edge;

wherein the drafting tool is configured for use with a drafting instrument;

wherein the anchored straight edge is used to draw straight lines on a top sheet;

wherein the rotating straight edge is used to draw straight lines on the top sheet;

wherein the drafting tool is configured for use with a pad of paper;

wherein the pad of paper is further defined with the top sheet;

wherein the drafting tool attaches to the pad of paper;

wherein the anchored straight edge attaches to the pad of paper such that the position of the anchored straight edge relative to the top sheet of the pad of paper is fixed;

wherein the rotating straight edge comprises a rectangular plate, a first notch, and a second notch;

wherein the first notch is formed in the rectangular plate;

wherein the second notch is formed in the rectangular plate;

wherein the rectangular plate is further defined with a first primary edge, a second primary edge, a first lateral edge, and a second lateral edge;

wherein the first notch is a negative space formed through the rectangular plate;

wherein the second notch is a negative space formed through the rectangular plate;

wherein the first notch has the shape of a circular section;

wherein the second notch has the shape of a circular section;

wherein the first primary edge of the rectangular plate aligns with a bifurcating line of the circular section that forms the first notch;

wherein the second primary edge of the rectangular plate aligns with a bifurcating line of the circular section that forms the second notch.

2. The drafting tool according to claim 1 wherein the slewing bearing adjusts the first cant of the rotating straight edge relative to the anchored straight edge such that a first cant is formed between a second line drawn using the rotating straight edge and a first line drawn using the anchored straight edge;

wherein the slewing bearing is calibrated;

wherein the first cant formed between the first line and the second line is adjustable over the entire arc of a circle;
wherein the rotating straight edge is a plate;
wherein the rotating straight edge has the shape of a rectangular block;
wherein the rotating straight edge attaches to the anchored straight edge such that the rotating straight edge rotates relative to the anchored straight edge;
wherein the rotating straight edge is used with a drafting instrument to draw a second line;
wherein the anchored straight edge is a rectilinear structure;
wherein the anchored straight edge has the shape of a hyoid.

3. The drafting tool according to claim 2 wherein the anchored straight edge attaches to the pad of paper such that any initial first line drawn on the top sheet using the anchored straight edge is parallel to any subsequent first line drawn on the top sheet using the anchored straight edge.

4. The drafting tool according to claim 3
wherein the anchored straight edge comprises a first arm, a second arm, and a crossbeam;
wherein the crossbeam attaches the first arm to the second arm;
wherein the first arm attaches to an edge of the crossbeam such that the first arm projects perpendicularly away from the crossbeam;
wherein the second arm attaches to an edge of the crossbeam such that the second arm projects perpendicularly away from the crossbeam.

5. The drafting tool according to claim 4
wherein the first arm is a plate with a rectangular block shape;
wherein the second arm is a plate with a rectangular block shape;
wherein the first arm projects away from the crossbeam in the direction away from the surface of the crossbeam upon which the slewing bearing is mounted;
wherein the second arm projects away from the crossbeam in the direction away from the surface of the crossbeam upon which the slewing bearing is mounted.

6. The drafting tool according to claim 5
wherein the crossbeam is a plate with a rectangular block shape;
wherein the crossbeam forms a plurality of straight edges that will guide the drafting instrument during the formation of a straight first line.

7. The drafting tool according to claim 6
wherein the second arm is identical to the first arm;
wherein the second arm is located on the edge of the crossbeam that is distal from the first arm.

8. The drafting tool according to claim 7
wherein the first arm further comprises a first ledge;
wherein the second arm further comprises a second ledge;
wherein the first ledge is a plate with a rectangular block shape;
wherein the second ledge is a plate with a rectangular block shape;
wherein the first ledge attaches to the edge of the first arm that is distal from the crossbeam;
wherein the second ledge attaches to the edge of second arm that is distal from the crossbeam;
wherein the first ledge projects perpendicularly away from the first arm in the direction towards the second arm;
wherein the second ledge projects perpendicularly away from the second arm in the direction towards the first arm.

9. The drafting tool according to claim 8
wherein the first ledge hooks around the surface of the pad of paper that is distal from the top sheet of the pad of paper;
wherein the second ledge hooks around the surface of the pad of paper that is distal from the top sheet of the pad of paper.

10. The drafting tool according to claim 9
wherein the rectangular plate is a plate with a rectangular block shape;
wherein the slewing bearing attaches to the surface of the rectangular plate that is proximal to the crossbeam;
wherein the slewing bearing attaches to the surface of the crossbeam that is proximal to the rotating straight edge;
wherein the slewing bearing attaches the rectangular plate to the crossbeam such that the rectangular plate rotates relative to the crossbeam.

11. The drafting tool according to claim 10
wherein the centers of the circles that form the first notch and the second notch are positioned on the rectangular plate such that the center of the rectangular plate, the center of the circle that forms the first notch, and the center of the circle that forms the second notch align;
wherein the line formed by the center of the rectangular plate, the center of the circle that forms the first notch, and the center of the circle that forms the second notch is perpendicular to both the first primary edge and the second primary edge.

12. The drafting tool according to claim 11
wherein the slewing bearing attaches the rotating straight edge to the anchored straight edge such that the center of the slewing bearing, the center of the anchored straight edge, and the center of the rotating straight edge are aligned;
wherein the alignment of the slewing bearing is such that the line formed by the centers of the anchored straight edge, the rotating straight edge, and the slewing bearing are perpendicular to both the anchored straight edge and the rotating straight edge;
wherein the slewing bearing attaches the rotating straight edge to the anchored straight edge such that face of the rotating straight edge is parallel to the face of the anchored straight edge.

13. The drafting tool according to claim 12
wherein the slewing bearing comprises an upper truncated cone and a lower truncated cone;
wherein the upper truncated cone attaches to the lower truncated cone;
wherein the upper truncated cone forms the portion of the slewing bearing that attaches to the rotating straight edge;
wherein the lower truncated cone forms the portion of the slewing bearing that attaches to the anchored straight edge;
wherein the upper truncated cone is further defined with an upper base, an upper apex, and an upper lateral face;
wherein the lower truncated cone is further defined with a lower base, a lower apex, and a lower lateral face;
wherein the upper base is further defined with an upper diameter;
wherein the lower base is further defined with a lower diameter;
wherein the upper apex is parallel to the upper base;
wherein the lower apex is parallel to the lower base;

wherein the span of the diameter of the lower apex equals the span of the diameter of the upper apex.

14. The drafting tool according to claim 13 wherein the upper base of the upper truncated cone attaches to the rectangular plate such that the center axis of the upper truncated cone passes through the center of the rectangular plate;

wherein the lower base of the lower truncated cone attaches to the crossbeam such that the center axis of the lower truncated cone passes through the center of the crossbeam.

15. The drafting tool according to claim 14 wherein the span of the upper diameter of the upper base is less than or equal to the perpendicular span of the distance between the first primary edge and the second primary edge;

wherein the span of the lower diameter of the lower base is less than or equal to the perpendicular span of the distance between the first primary edge and the second primary edge;

wherein the span of the lower diameter of the lower truncated cone is greater than the span of the upper diameter of the upper truncated cone.

16. The drafting tool according to claim 15 wherein a bearing attaches the lower apex to the upper apex such that the upper truncated cone rotates relative to the lower truncated cone.

17. The drafting tool according to claim 16 wherein the lower truncated cone further comprises an angular calibration;

wherein the angular calibration is a collection of markings formed on the lower lateral face of the lower truncated cone;

wherein the angular calibration provides a visual indication of the span of the arc of a circle.

18. The drafting tool according to claim 17 wherein the opening formed by the first notch creates a first visible space through which the angular calibration of the slewing bearing can be viewed;

wherein the opening formed by the second notch creates a second visible space through which the angular calibration of the slewing bearing can be viewed.

* * * * *